United States Patent [19]

Herchenbach

[11] 4,417,821

[45] Nov. 29, 1983

[54] WRIST WATCH

[75] Inventor: Wolfgang Herchenbach, Pforzheim, Fed. Rep. of Germany

[73] Assignee: Rodi & Wienenberger AG, Pforzheim, Fed. Rep. of Germany

[21] Appl. No.: 317,928

[22] Filed: Nov. 3, 1981

[30] Foreign Application Priority Data

Nov. 15, 1980 [DE] Fed. Rep. of Germany ..... 3043263
Apr. 24, 1981 [DE] Fed. Rep. of Germany ..... 3116306

[51] Int. Cl.[3] ..... G04C 23/02; G04B 37/08

[52] U.S. Cl. ..... 368/291; 368/276; 368/281; 368/286; 368/294

[58] Field of Search ..... 368/282, 294, 295, 309, 368/312, 287, 276, 281, 286, 291, 292, 296, 299, 300

[56] References Cited

U.S. PATENT DOCUMENTS

| | | | |
|---|---|---|---|
| 1,150,930 | 8/1915 | Cohn | 368/287 |
| 2,252,647 | 8/1941 | Schmitz | 368/294 |
| 3,292,362 | 12/1966 | Klingenberg | 368/295 |
| 3,469,391 | 9/1969 | Thevenaz | 368/282 |
| 3,712,049 | 1/1973 | Luxembourg | 368/281 |
| 3,740,944 | 6/1973 | Chopard | 368/281 |
| 3,901,023 | 8/1975 | Uebelhardt | 368/281 |
| 4,034,552 | 7/1977 | Davidson | 368/282 X |
| 4,104,867 | 8/1978 | Worsham | 368/291 |
| 4,117,658 | 10/1978 | Miyasaka et al. | 368/291 |
| 4,122,664 | 10/1978 | Stampfli | 368/291 X |
| 4,194,355 | 3/1980 | Nishida | 368/282 |
| 4,197,698 | 4/1980 | Finger | 368/291 |
| 4,222,228 | 9/1980 | Masui | 368/291 |
| 4,234,948 | 11/1980 | Maekawa et al. | 368/291 |
| 4,244,044 | 1/1981 | Olsson | 368/291 |
| 4,272,838 | 6/1981 | Kasama et al. | 368/276 X |

FOREIGN PATENT DOCUMENTS

| | | | |
|---|---|---|---|
| 321188 | 6/1957 | Switzerland | 368/282 |
| 336017 | 3/1959 | Switzerland | 368/294 |
| 355095 | 7/1961 | Switzerland | 368/282 |

*Primary Examiner*—J. V. Truhe
*Assistant Examiner*—Terry Flower
*Attorney, Agent, or Firm*—Michael J. Striker

[57] ABSTRACT

A wrist watch, particularly a water-tight wrist watch, has upper and lower housing parts, a watch mechanism received in the lower housing part, a watch glass, a dial member, a spacer member, and an elastic element in the lower housing part arranged so that the upper housing part presses the watch mechanism via the watch glass, the spacer member and the dial member against the elastic element. The upper housing part has a collar extending over the spacer member and lying on a step portion of the watch glass.

30 Claims, 5 Drawing Figures

WRIST WATCH

BACKGROUND OF THE INVENTION

The present invention relates to a wrist watch, particularly a water-tight wrist watch. Wrist watches are widely known in the art. A known wrist watch has a lower housing part which is cup-shaped and receives a watch mechanism, an upper housing which is frame-shaped, and a watch glass which is pressed by the upper housing part to the lower housing part with interposition of a sealing ring, wherein housing parts are connected with one another by screws or other holding means. There are different systems in which individual parts of a wrist watch are mounted from above in the housing lower part and closed by a lunette and/or watch glass. In one of the known wrist watches, it is known to close the watch by screwing a frame-shaped lunette onto a holder formed on the housing lower part for mounting the watch strap, wherein the watch glass rests on a projection of the lower housing part. It is further known for closing the wrist watch to lock the watch glass from above with bayonet locking. In this construction the watch glass is pressed against an elastic element arranged on a housing shoulder and has a radial limiting portion formed as a sleeve abutting against the watch dial. This sleeve is provided for closing the seat of the elastic element and has play relative to the glass.

The known wrist watches of the above mentioned general type have a relatively complicated construction. They have several grooves, projections, shoulders for abutting the sealing ring and receiving the watch mechanism, or they require a special watch mechanism carrier formed for example as a sleeve, ring or the like. The exact placing of the watch mechanism relative to the housing parts, particularly relative to an opening for a setting shaft, always encounters difficulties. The impact-absorbing support of the watch mechanism is also difficult and time-consuming because of the utilization and adjustment of additional individual parts, such as elastic rings and the like, which are built in gaps, grooves, or on shoulders for impact-absorbing purposes. The protection against penetration of dust and water into the housing of the watch takes place in different ways, whereby elastic sealing means formed conventionally as rings are inserted between the individual parts of the watch to be connected with one another. They do not, however, provide for completely satisfactory tightness; also, water which is condensed in conditions of low temperature in the interior of the watch cannot be sufficiently released. Moreover, since these watches are composed of a plurality of individual parts, the mounting of such wrist watches is complicated and time-consuming, and instruments and manufacturing costs are high because the individual parts must be manufactured with high precision.

In the known wrist watches, the watch strap is fixed on the housing by mounting means from outside. Between the watch strap and the wrist watch itself an optically unpleasant intermediate space is formed. When the watch strap is soldered on the wrist watch, undesirable solder traces remain visible and they cannot be avoided even in the event of very careful work. Moreover, one wrist watch model cannot be readily utilized for different watch strap types, since they are provided with other connecting means, so that the manufacturer must provide and make a considerable number of basic models to remain able to compete.

SUMMARY OF THE INVENTION

Accordingly, it is an object of the present invention to provide a wrist watch which avoids the disadvantages of the prior art.

More particularly, it is an object of the present invention to provide a wrist watch which is composed of a small number of individual parts which can be assembled in an easy and fast manner and also satisfies the requirements offered to a high-quality wrist watch.

It is also an object of the present invention to provide a wrist watch with such a mounting of a watch strap in a watch housing, which makes possible to provide a basic model of a watch housing with different watch straps and to use different watch straps with only one model so as to guarantee an economical manufacturing process for the watch manufacturer.

In keeping with these objects and with others which will become apparent hereinafter, one feature of the present invention resides, briefly stated, in a wrist watch in which an upper housing part presses a watch mechanism via a watch glass, a spacer member, and a dial member, against an elastic element received in a lower housing part. A collar-like portion of the upper housing part extends over the spacer member and lies on a step portion of the watch glass.

The wrist watch designed in accordance with the present invention has a small number of individual parts which makes possible a fast and simple mounting. Since the housing lower part is formed as a one-piece member and does not have a separate bottom, a bottom sealing can be dispensed with. Also, a watch mechanism support is dispensed with in this construction. On the one hand, the upper housing part presses the individual parts which contact one another downwardly, whereas the elastic element arranged in the lower housing part applies, on the other hand, a counterpressure from below through all the parts against the watch glass or the upper housing part. Simultaneously, the elastic element which is advantageously formed as a foamed cushion member, performs the function of an impact-absorbing element inasmuch as all parts are arranged one above the other in a springy manner. Naturally, the elastic element can also be arranged between the lower housing part and the dial member in the event that the watch mechanism is mounted on the dial member. In such an arrangement, the dial member is somewhat wider as compared with the first mentioned construction and extends beyond the inner contour of the cutout of the lower housing part to a small extent. The arrangement of these individual parts, in which they are located one on the other in a springy manner, is especially advantageous because of the tolerance insensitivity.

In accordance with another feature of the present invention, a sealing ring formed as an O-sealing member is arranged at an outer surface of the spacer ring. This makes possible an easy mounting of the sealing ring not only in round but also in shaped openings. On the sealing ring rests the step portion of the watch glass extending at the periphery of the latter. In the known wrist watches such sealing rings can be seen through the watch glass and disrupt the harmony of the optics. When the wrist watch is designed in accordance with the inventive construction, the sealing ring is completely covered, inasmuch as the inner contour of the spacer ring concealing the sealing ring forwardly coincides with the inner contour of the collar portion of the upper housing part, whereas the collar portion bridges the stop of the watch glass. As a result of this, only those parts of the wrist watch are visible which are intended to be seen.

In accordance with still another feature of the present invention, the watch strap is clamped and hooked, contrary to conventional constructions, in the respectively shaped separating gap between the upper housing part and the lower housing part. A further feature of the present invention is that the separating gap has a wrist strap receiving recess which is formed so that, in spite of the integration of the watch strap in the housing, the watch strap can be moved from the housing upon separation of the upper and lower housing parts, and different other watch straps can be inserted into the strap receiving recess.

Still a further feature of the present invention is that the strap receiving recess includes an elongated slot extending substantially over the entire width of an outer wall of the lower housing part and into the body of the same, and lateral depressions provided laterally of the elongated slot and forming end projections in the housing. The bottom surface of the recess is inclined in correspondence with the starting angle of the watch strap In accordance with still a further feature of the present inventon, an engaging member is connected with each end of the watch strap and arranged so that upon insertion of the end of the watch strap into the elongated slot, the engaging member engages by its laterally projecting parts into the above mentioned lateral depressions of the strap receiving recess. The watch strap can be composed of a metal fine links, whereas the engaging member may be formed as a hard-shaped wire inserted into or glued to the end of the strap halves.

It is also possible for the utilization of a metal link strap to cut the end link of the metal straps at both sides of its end portion so as to form pins engaging behind the projections of the lower housing part.

When a milanese watch strap is utilized, the engaging member can be formed as a hard wire soldered at each strap end and extending outwardly beyond the strap width to again engage behind the projections of the lower housing part.

A leather strap is also suitable for connection with the inventive wrist watch, similarly to the metal straps. In accordance with the invention, a hard metal member is inserted into each end of the leather strap and extends laterally outwardly of the latter to engage behind the projections of the lower housing part.

The above mentioned hard metal member may be composed of a refined steel sheet plate having a thickness of several tenth millimeters and a length of approximately 2–4 millimeters, and width corresponding to the width of the watch strap, wherein this metal member is provided with two projecting pins extending laterally beyond the strap and again engaging behind the projections of the lower housing part.

When a stretchable metal strap is utilized, which is known for example under the tradename "FIXO-FLEX", the last upper strap link at each strap end engages in the strap receiving recess in the lower housing part and a hard-shaped wire extending through the last upper strap link and projecting and both sides therefrom engages behind the projections of the lower housing part.

These novel features of the invention can also be utilized in other constructions of the housings with obtaining considerable advantages. No extension of the housing because of the required mounting means is necessary, no extra parts such as for example holders or spring webs are needed, no soldering of watch strap which usually leads to solder spots is needed.

The mounting of the watch straps between the upper housing part and the lower housing part in accordance with the invention provides for an effortless exchange of one watch strap for another, which is harmoniously inserted into the wrist watch. The watch strap is completely integrated in the housing. Since the exchange must be performed by separation of the upper housing part from the lower housing part, another watch strap can be inserted by a person who is not a specialist and without special auxiliary means.

The required watch mechanism is inserted in the wrist watch of the invention and activated by a pusher. The utilization of such a watch mechanism for which the pusher is premounted in the lower housing part, makes possible a simple mounting by fitting of all parts one onto the other and screwing the upper housing part to the lower housing part. The adjustment of the watch mechanism relative to a predetermined opening of a setting shaft is dispensed with.

When the wrist watch is provided with analog indicating means, the numbers or the respective symbols can be milled, pressed or brought in other manner onto the collar portion of the upper housing part. Thereby the manufacture of the dial member is simplified. At the same time, the appearance of the wrist watch is expensive and elegant, inasmuch as, particularly in small ladies' watches, the dial member, because of the numbers provided thereon, appears to be optically narrow. When the upper housing part is composed of roll gold-steel-double, two-color effects can be provided in that the roll gold layer can be removed to an extent so that the numbers or the associated symbols can appear in steel color. In this case, the lower housing part can be composed of steel, and the watch strap can be composed of roll gold-steel-double.

In order to avoid unused free space in the interior of the housing and to dispense with the conventional watch mechanism support, the lower housing part in accordance with another advantageous feature of the present invention has such a mechanism receiving hollow as to correspond to the contour of the watch mechanism.

Finally, an additional feature of the present invention is that the lower housing part has inwardly open pocket holes or other recesses provided advantageously in a massive region of the lower housing part at a location where the contour of the dial member extends outwardly beyond the contour of the watch mechanism. These hollows are filled with kieselguhr or another hygroscopic material which aspirates moisture eventually precipitating in the interior of the wrist watch, so as to prevent formation of condensation water in condition of very low temperatures. The kieselguhr is used in bound form, so that its particles can not flow into the interior of the housing.

The novel features which are considered characteristic for the invention are set forth in particular in the appended claims. The invention itself, however, both as to its construction and its method of operation, together with additional objects and advantages thereof, will be best understood from the following descrition of specific embodiments when read in connection with the accompanying drawing.

DESCRIPTION OF THE PREFERRED EMBODIMENTS

Figure 1:
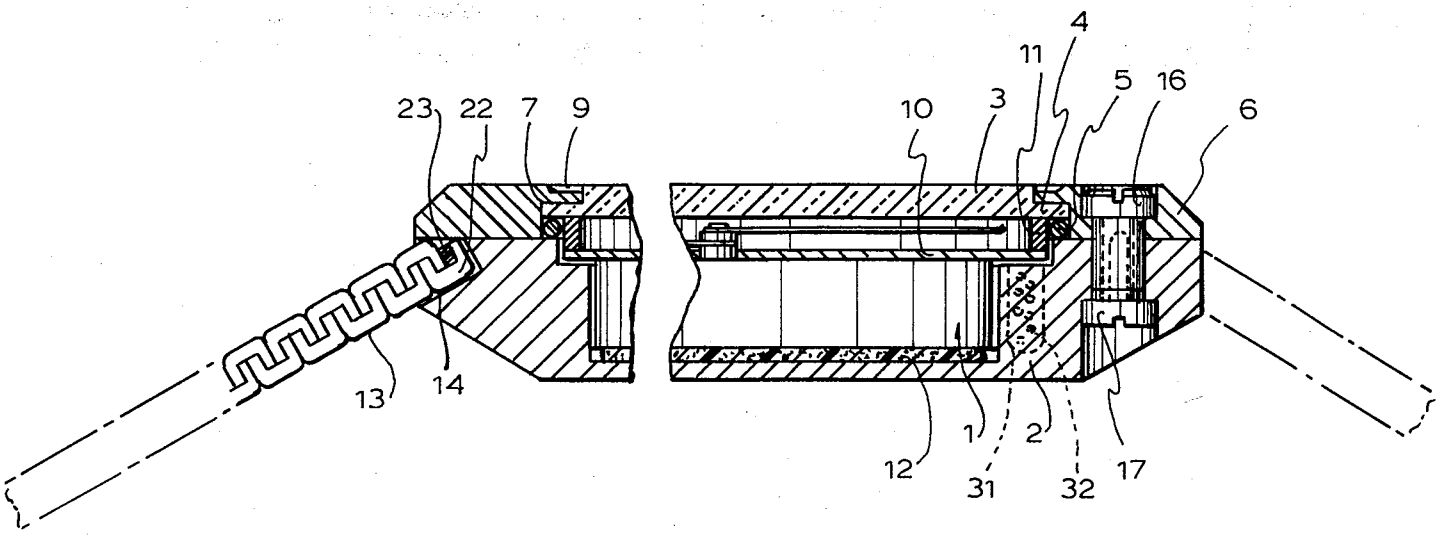
FIG. 1 is a view showing a partial section of a wrist watch in accordance with the present invention.

A wrist watch in accordance with the present invention has a lower housing part 2 which is cup-shaped and receives a watch mechanism 1, a watch glass 3 with a step 4 formed at its periphery and abutting against a sealing ring 5, and a frame-shaped upper housing part 6 with an inner opening having a collar 7. The upper housing part 6 is connected with the lower housing part 2 by screws 8, 16 and 17 or other holding means.

In the wrist watch with analog indicating means, numbers 9 or other respective symbols are milled, pressed or formed in other manner in the collar 7 of the upper housing part 6. A spacer ring 11 is provided between the watch glass 3 and a dial member 10, and a sealing ring 5 abuts against the outer surface of the spacer ring 11. An elastic element formed for example as a foamed cushion member 12 is inserted into the lower housing part 2, and the watch mechanism 1 rests on this elastic element. The hollow formed in the lower housing part 2 for receiving the watch mechanism 1 has such dimensions that its contour corresponds to the contour of the watch mechanism 1.

A separating gap 14 is provided between the upper housing part 6 and the lower housing part 2. A watch strap 13 is clamped and hooked in the separating gap 14. The watch mechanism 1 is actuated by a pusher 15 which is premounted in the lower housing part 2. The lower housing part 2 has a massive region, and inwardly open pocket holes 31 or other recesses 31 are provided in this region at a location where the contour of the dial member 10 extends beyond the contour of the watch mechanism 1. The above mentioned pocket holes or recesses are filled with kieselguhr 32 in bound form or other hygroscopic material.

The inventive wrist watch is mounted in a simple and fast manner because it includes a small number of uncomplicated parts, and because the pusher 15 is premounted so that the time-consuming adjustment of the watch mechanism is dispensed with. All parts are arranged one above the other in a springy manner. The foamed cushion member 12 is inserted into the lower housing part, in which the pusher 15 has been premounted and pocket holes filled with kieselguhr or other hygroscopic material. The watch mechanism 1 is inserted above the cushion member 12 into the exactly corresponding hollow, together with the dial member 10 in a conventional member. The spacer ring 11, which carries at its outer surface the sealing ring 5, is placed onto the dial member 10 over its periphery. The watch glass 3 with its step 4 is placed onto the spacer ring 11 with the sealing ring 5. The watch strap 13 is inserted at both sides into the separating gap 14 in the housing lower part 2. For closing the wrist watch shown in FIG. 1, the hollow screw 16 extending from the upper housing part 6 through a respective opening and having an inner thread is screwed with a screw 17 extending from the lower housing part 2 in a respective opening. As a result of this, the watch strap 13 is clamped in the separating gap 14 between the upper housing part 6 and the lower housing part 2. The collar 7 presses via the step 4 of the watch glass against the sealing ring 5 and the spacer ring 11. The sealing ring 5 is deformed so that it firmly abuts against the step 4 of the watch glass and the upper surface of the lower housing part 2, whereby a seal-tightness of the watch is obtained. The pressure is transmitted from the spacer ring 11 further via the dial member 10 and the watch mechanism 1 onto the foamed cushion member 12 located therebelow. When the foamed cushion member 12 is compressed it applies counterpressure via the individual parts upwardly and these parts are pressed in a springy manner against the upper housing part 6. The foamed cushion member 12 serves simultaneously as an impact-absorbing element for the watch mechanism 1.

Figure 2:
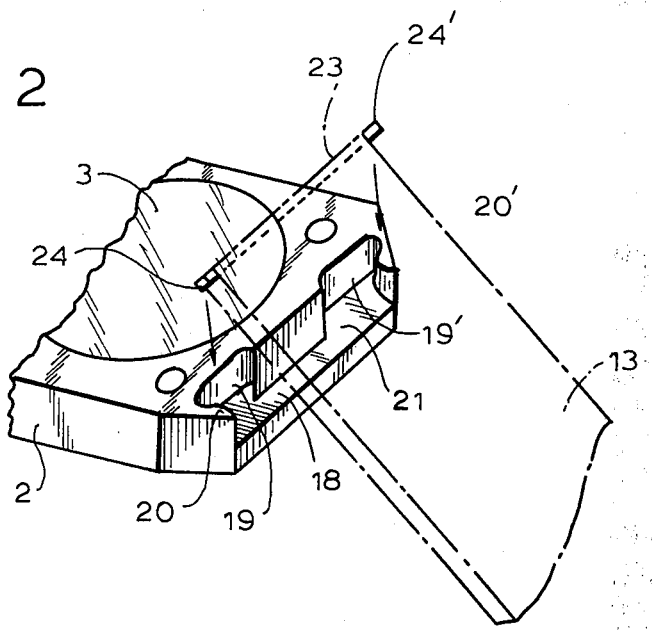
FIG. 2 is a partial perspective view of a lower housing part of the inventive wrist watch with a portion of a watch strap.
Figure 4:
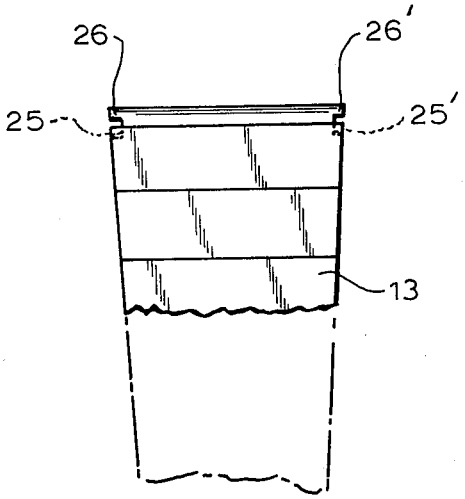
FIG. 4 is a view showing an end link of a metal watch strap, to be inserted into the lower housing part of the inventive wrist watch.

For receiving the endds of the watch strap halves 13, advantageously the lower housing part 2 is provided with a recess 18 which extends approximately over the entire width of the outer wall of the lower housing part 2, as shown in FIG. 2. The recess 18 terminates at both its sides in depressions 19 and 19' which are formed so as to provide projections 20 and 20' at the outer side of the lower housing part 2. A bottom surface 21 of the recess 18 is inclined in correspondence with the starting angle of the watch strap 13. The end of the watch strap 13 is inserted into the recess 18.

When the watch strap is composed of metallic fine links, a hard-shaped wire 23 can be inserted into or glued to the last strap link 22. When the watch strap is formed as a milanese strap, a hard wire can be soldered on the end of the strap. In the event of a stretchable watch strap, a hard-shaped wire extends through the last upper strap link and engages in the recess 18 of the lower housing part 2. The shaped wire 23 at the strap end extends at both sides of the latter outwardly beyond the strap width and engages with its extending end portions 24 and 24' behind the projections 20 and 20' of the recess 18, so that the watch strap 13 cannot be withdrawn therefrom.

Instead of the utilization of the profiled wire with the metal watch strap, the end links of the watch strap 13 can be formed with cuts 25 and 25' at its ends so that pins 26 and 26' are formed at these ends. The pins 26 and 26' engage behind the projections 20 and 20' of the recess 18 in the lower housing part 2.

Figure 3:
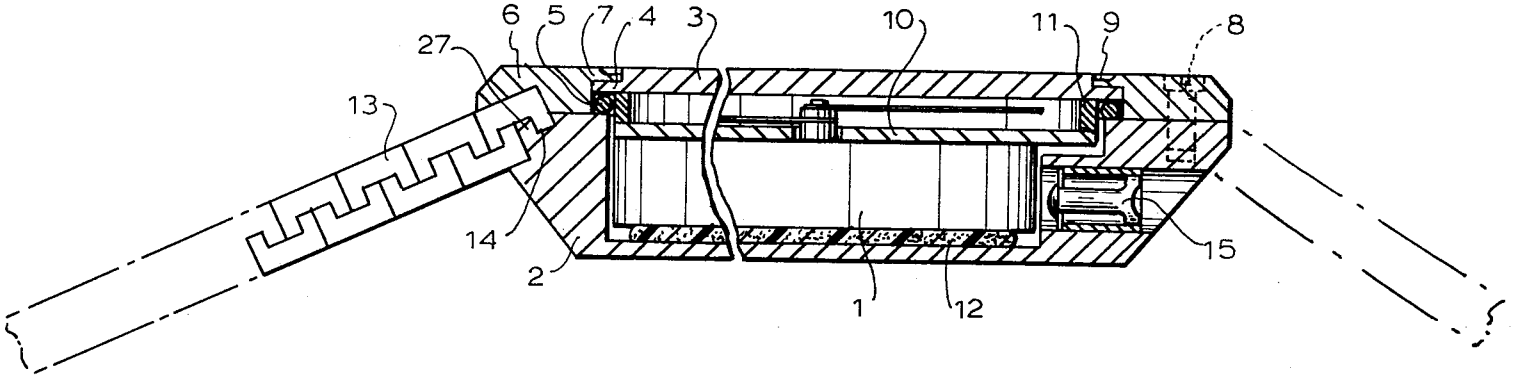
FIG. 3 is a view showing a partial section of the inventive wrist watch with another specially shaped separating gap between the housing parts.

FIG. 3 shows the separating gap 14 in accordance with another embodiment. The watch strap 13 hooks with its last link 22 behind a milled projection 27.

Figure 5:
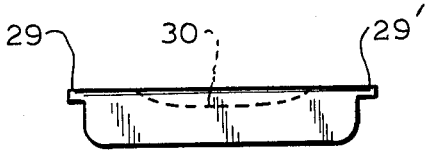
FIG. 5 is a view showing a metal member for reinforcing a leather watch strap for the inventive wrist watch.

When a leather watch strap is utilized, a hard metal member 28 can be inserted into the end portion of the leather strap is shown in FIG. 5. The metal member 28 is composed of a refined steel sheet plate having a thickness of several tenths of a millimeter a length of approximately 2–4 millimeters, and a width corresponding to the width of the watch strap. The metal member 28 has at both its outer ends two pin-like projections 29 and 29' which extend outwardly beyond the width of the strap and engage behind the projections 20 and 20' of the recess 18 in the lower housing part 2. For providing more play during insertion of the leather watch strap, and thereby guaranteeing its easier insertion, the above mentioned metal member can have at its upper edge a cut-out 30.

When the wrist watch in accordance with the present invention is closed by the frame-shaped upper housing part 6 as described hereinabove, the lower side of the upper housing part 6 lies flat on the upper side of the lower housing part 2 and holds the watch strap half 13 in a secure but sufficiently movable manner. No closing or mounting means for the watch strap 13 on the housing are visible. The watch itself and the watch strap together form a unit of harmonious appearance.

It will be understood that each of the elements described above, or two or more together, may also find a useful application in other types of constructions differing from the types described above.

While the invention has been illustrated and described and embodied in a wrist watch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A wrist watch, particularly a water-tight wrist watch, comprising a housing having a substantially cup-shaped lower housing part and a substantially frameshaped upper housing part connected with one another, said upper housing part having a collar-like portion; a watch mechanism received in said lower housing part; a watch glass having a step portion; a dial member; a spacer member having a wall; and an elastic element arranged in said lower housing part, said upper housing part pressing said watch mechanism via said watch glass, said spacer member and said dial member against said elastic member, and said collar-like portion of said upper housing part extending over said wall of said spacer member and lying on said step portion of said watch glass.

2. A wrist watch as defined in claim 1; and further comprising a sealing ring arranged between said watch glass and said lower housing part, said watch glass being clamped between said lower housing part with interposition of said sealing ring, and said upper housing part.

3. A wrist watch as defined in claim 1, wherein said elastic element is formed as a foamed cushion member.

4. A wrist watch as defined in claim 1, wherein said spacer member has an inner contour, said collar-like portion extending inwardly to said inner contour of said spacer member.

5. A wrist watch as defined in claim 1, wherein said housing has an axis, said upper housing part having an inner opening and said collar-like portion of said upper housing part extending radially inwardly, said step portion of said watch glass extending radially outwardly.

6. A wrist watch as defined in claim 1, wherein said spacer member is formed as a spacer ring having an outer surface; and further comprising a sealing ring arranged at said outer surface of said spacer ring and overlapped by said step portion of said watch glass.

7. A wrist watch as defined in claim 6, wherein said sealing ring is formed as an O-sealing member.

8. A wrist watch as defined in claim 1, wherein said housing has a separating gap between said upper and lower housing parts; and further comprising a watch strap clamped and hooked in said separating gap.

9. A wrist watch as defined in claim 8, wherein said separating gap includes a strap receiving recess formed so that by separation of upper and lower housing parts from one another said watch strap can be separated from said housing and different watch straps can be inserted in said housing.

10. A wrist watch as defined in claim 9, wherein said strap receiving recess is formed in said lower housing part.

11. A wrist watch as defined in claim 10, wherein said lower housing part has an outer wall of a predetermined width, said strap receiving recess including an elongated slot extending substantially over the entire width of said outer wall of said lower housing part and into the same, and lateral depressions provided laterally of said elongated slot and forming end projections.

12. A wrist watch as defined in claim 11, wherein said watch strap has a predetermined starting angle, said elongated slot having a bottom surface which is inclined in correspondence with said starting angle of said watch strap.

13. A wrist watch as defined in claim 11, wherein said watch strap has a predetermined width and two ends; and further comprising engaging members each connected with a respective one of said ends of said watch strap and projecting outwardly beyond the width of the latter, so that upon insertion of one of said ends of said watch strap into said elongated slot, said engaging member engages behind said projections.

14. A wristwatch as defined in claim 13, wherein said watch strap is composed of metal filings, whereas each of said engaging members is formed as a hard profiled wire.

15. A wrist watch as defined in claim 14, wherein each of said wire engaging members is inserted into a respective one of said ends of said watch strap.

16. A wrist watch as defined in claim 14, wherein each of said wire engaging members is glued to a respective one of said ends of said watch strap.

17. A wrist watch as defined in claim 13, wherein said watch strap has two ends and two end links at said ends, each of said end links having recesses defining pins which form said engaging member, so that upon insertion of a respective one of said end links in said elongated slot said pins engage behind said projections.

18. A wrist watch as defined in claim 13, wherein said watch strap is a milanese watch strap, whereas said engaging member is composed of a hard wire and soldered to said milanese watch strap.

19. A wrist watch as defined in claim 13, wherein said watch strap is composed of leather, said engaging member being formed as a hard metal member secured to a respective one of said ends of said watch strap.

20. A wrist watch as defined in claim 19, wherein each of said metal members includes a superrefined steel sheet plate with a thickness of several tenth of a millimeter, length of substantially 2–4 millimeters, and width corresponding to the width of said watch strap, and two pin-shaped portions provided at both ends of said plate and engaging behind said projections upon insertion of said plate in said elongated slot.

21. A wrist watch as defined in claim 13, wherein said watch strap is formed as a stretchable metal band having a plurality of links including a last upper link, said engaging member being composed of a hard wire extending transversely through and projecting laterally beyond a respective one of said end upper links.

22. A wrist watch as defined in claim 1, wherein said watch mechanism is a quartz watch mechanism; and further comprising a pusher actuating said quartz watch mechanism.

23. A wrist watch as defined in claim 1; and further comprising analog indicating means with a plurality of time-indicating numbers formed in said collar-like portion of said upper housing part.

24. A wrist watch as defined in claim 23, wherein said time-indicating numbers is milling-produced numbers on said collar-like portion.

25. A wrist watch as defined in claim 23, wherein said time-indicating numbers is pressing-produced on said collar-like portion.

26. A wrist watch as defined in claim 1, wherein said watch mechanism has a predetermined contour, said watch dial having a contour extending at least partially beyond said watch mechanism, and said lower housing part having a watch mechanism receiving hollow with a contour corresponding to the contour of said watch mechanism.

27. A wrist watch as defined in claim 26; and further comprising a body of a hygroscopic material received in a recess and arranged in a region where the contour of said watch dial extends outwardly beyond the contour of said watch mechanism.

28. A wrist watch as defined in claim 27, wherein said recess which receives said body of hygroscopic material is formed as an inwardly open pocket hole.

29. A wrist watch as defined in claim 27, wherein said hygroscopic material of said body is kieselguhr.

30. A wrist watch as defined in claim 27, wherein said lower housing part has a massive region, said recess which receives said body of hygroscopic material being formed in said massive region of said lower housing part.

* * * * *